US005795099A

United States Patent [19]

Parker

[11] Patent Number: 5,795,099

[45] Date of Patent: Aug. 18, 1998

[54] APPARATUS TO CONTROL BEACH EROSION

[76] Inventor: James W. Parker, 307 C St., St. Augustine Beach, Fla. 32084

[21] Appl. No.: 631,375

[22] Filed: Apr. 12, 1996

[51] Int. Cl.[6] ..... E02B 3/06

[52] U.S. Cl. ..... 405/28; 256/12.5; 405/21; 405/258

[58] Field of Search ..... 405/15–20, 28–35, 405/258; 256/12.5

[56] References Cited

U.S. PATENT DOCUMENTS

| | | | |
|---|---|---|---|
| 2,655,790 | 10/1953 | Daley | 405/28 |
| 3,011,316 | 12/1961 | Wilson | 405/28 |
| 3,037,726 | 6/1962 | Phillips | 256/12.5 X |
| 3,214,916 | 11/1965 | Martin | 405/28 |
| 3,473,786 | 10/1969 | Luebke | 256/12.5 |
| 3,913,889 | 10/1975 | Nugent et al. | 256/12.5 |
| 3,966,172 | 6/1976 | Garrett | 256/12.5 |
| 4,089,179 | 5/1978 | Trautman | 256/12.5 X |

FOREIGN PATENT DOCUMENTS

| | | | |
|---|---|---|---|
| 2107233 | 8/1971 | Germany | 256/12.5 |

*Primary Examiner*—Dennis L. Taylor
*Attorney, Agent, or Firm*—Thomas C. Saitta

[57] ABSTRACT

An apparatus for controlling, reducing and preventing beach erosion comprises an elongated barrier formed of an apertured support grid and mesh material, where the mesh material is permeable to water but not to sand and where the mesh material comprises a number of flaps able to open only in the on-shore direction, such that water flow in the on-shore direction will cause the flaps to open, but water flow in the off-shore direction will cause the flaps to close against the support grid. Water will permeate through mesh apertures in the mesh material but sand particles will be retained on the on-shore side of the mesh material.

13 Claims, 2 Drawing Sheets

APPARATUS TO CONTROL BEACH EROSION

BACKGROUND OF THE INVENTION

This invention relates generally to an apparatus to prevent or control beach erosion by retaining behind a barrier system sand picked up by abnormally high tides or storm wave action. More particularly, the invention relates to such an apparatus which retains the sand while allowing water to flow back into the body of water. Even more particularly, the invention is an apparatus which allows generally unimpeded water flow in the on-shore direction but which restricts the flow of the water in the return or off-shore direction and simultaneously separates the particulate components from the liquid components, such that water-borne sand is deposited on the on-shore side of the invention.

Erosion of beaches caused by unusually high tides or storm conditions on the shores of oceans and other large bodies of water is a serious problem, often threatening protective dunes, beachfront structures, and other property contiguous to the shoreline. Each year millions of dollars are spent to refurbish eroded beaches by dredging and depositing off-shore sand back onto the beach, sometimes only to see the entire project washed away by the next large storm. Development of an inexpensive system to prevent such erosion based on the general concept of a barrier or fence structure has been a goal for many years, but the various embodiments have been found lacking in many respects. For example, U.S. Pat. No. 226,772 to Mueller and U.S. Pat. No. 3,214,916 to Martin illustrate a basic concept known as shuttering to build up beaches and prevent erosion. The shutters are rigid solid panels which are hingedly mounted onto a framework such that the shutters will be pushed open by the force of waves in the on shore direction but are closed by the force of the returning water in the off-shore direction to present a barrier to prevent passage of water and sand. These structures are only suited for use where the structure is actually positioned in the body of water such that water from large waves will be able to pass over the structure. Because the panels are solid, the force from the large volume of returning water would knock down the structure or would create channels under the structure, eventually undermining it. Furthermore, such structures are costly to manufacture and install. An improved design for the shutter type barrier is shown in U.S. Pat. No. 2,655,790 to Daley. Daley provides a number of resilient flaps formed of thick rubber, plastic or the like, the flaps being mounted to a framework along the bottom of each flap. Daley allows the water to flow equally in either direction and is designed for creating sandbars by positioning the system in the water, and as such would be of little use in preventing beach erosion if set in place above the shoreline as the unimpeded off-shore flow of water and sand would not result in any sand being retained. A more modern approach is to utilize barriers of fabric or other sheet material which are apertured to create a mesh, such as shown in U.S. Pat. No. 3,540,587 to Dawbarn and U.S. Pat. No. 5,108,224 to Cabaniss et al. Such meshes have relatively small apertures which allows wind or water to flow through the material at a reduced rate, causing the sand carried by the air or water to be deposited on the entrance side of the material. The apertures are sized relatively large where large flow volumes are expected so that the barrier will not be pushed over by the force of the air or water. These devices present no advantage in a beach situation where there is a large variation between the force of the water in the on-shore direction versus the force of the return water in the off-shore direction. Apertures sized sufficient to prevent destruction of the barrier by oncoming waves will do little to retain sand contained in the water returning to the body of water.

It is an object of this invention to provide a barrier apparatus which is efficient in preventing beach erosion in a relatively low cost manner, is relatively easy to install and maintain, and most importantly is structured to compensate for the discrepancy of force between the large on-shore waves and the returning off-shore water. It is an object to provide such an apparatus which incorporates a support grid affixed along the shoreline above the high water mark, the grid supporting or comprising multiple apertures or gates covered by movable flaps of sufficient size to allow high water volume flow in the on-shore direction, the force of the waves pushing open the flaps, where the flaps are mounted relative to the apertures such that the force of the returning sand-laden water will close the flaps against the framework to present a generally uniform barrier, and further where the flaps are made of a mesh material with relatively small apertures such that water will flow in the off-shore direction through the material at a reduced rate whereby the sand will be deposited against the mesh material and not carried out into the body of water. It is a further object to provide such an apparatus where the size of the gate apertures and the size of the mesh apertures may vary and are determined by the expected volume of water and the size of sand particles to be encountered.

SUMMARY OF THE INVENTION

The invention is an apparatus for controlling, reducing or preventing beach erosion caused by high winds, high tides and storm situations where the waves impinge on the land area normally above the high water mark, such that sand is carried off the shore and into the body of water. The apparatus comprises in general an elongated barrier positioned above the high water mark along the shore line and generally parallel to the shore, the barrier being secured into the ground by a series of generally vertical posts. The barrier material is mounted to and extends between the posts, the barrier material comprising a support grid and coextensive mesh material selectively joined together. The support grid is made of a relatively strong frame material and comprises a large number of gate apertures which are large in area relative to the frame material comprising the support grid, such that the support grid presents a generally open surface so as to allow relatively unimpeded flow of water therethrough. The mesh material comprises a multiple number of horizontal flaps formed either by slitting the mesh material to form a three sided flap with the top edge of the flap remaining joined to the mesh material and the mesh material joined to the frame material along or adjacent this top edge, or by creating a number of individual horizontal flaps from the mesh material and attaching each along its top edge to the frame material. Each flap is sized greater than the size of a single gate aperture, and an individual flap is preferably sized to cover multiple gate apertures. Most preferably, each flap extends at least the full distance between the vertical posts. The flaps are mounted onto the support grid on the on-shore side of the apparatus and are positioned relative to the apertures such that the flaps may be forced open by water striking the apparatus in the on-shore direction, but whereby the flaps will be forced against the frame material defining the gate apertures when water returns in the off-shore direction, the sizing and positioning of the flap edges relative to the frame material preventing the flaps from opening in the off-shore direction. The mesh material forming the flaps comprises a number of relatively small apertures, such that water may flow through the mesh material, but at a reduced rate. Preferably, the mesh apertures are sized to be smaller than the average particle size of sand, such that sand particles cannot penetrate the mesh material and be carried off into the body of water. In this manner, large volume water flow from incoming waves can be accommodated since the flaps will open in the on-shore direction to allow the water through the apparatus, but in the reverse direction the return water flow, the force of which is typically spread over a longer time period, will be impeded to sufficient degree whereby the sand is caused to settle or be completely entrapped on the on-shore side, thereby preventing erosion of the beach.

DETAILED DESCRIPTION OF THE INVENTION

With reference to the drawings, the invention will now be described in detail with special regard to the best mode and preferred embodiment. In general, the invention is an apparatus to control beach erosion on a body of water likely to encounter unusually high winds, high tides, or storm waves and surges, which allows water to flow generally unimpeded in the on-shore direction but which restricts the return water flow in the off-shore direction to prevent sand particles borne by the water from being washed into the body of water.

Figure 1:
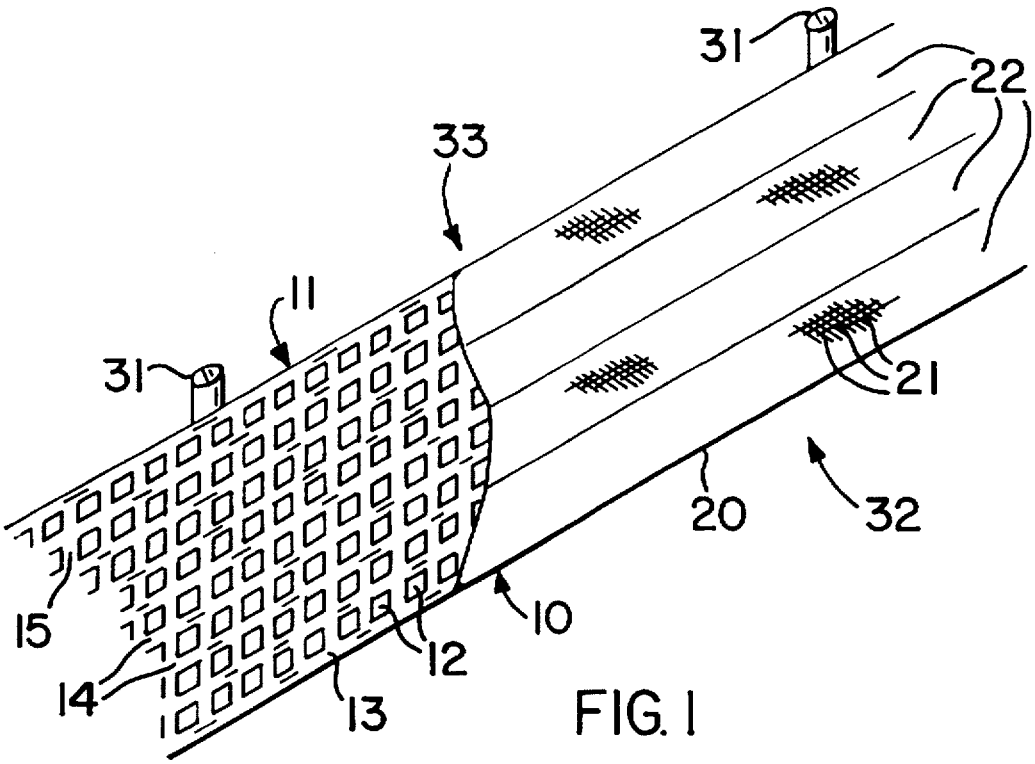
FIG. 1 is a perspective view of the invention, showing a portion of the mesh material removed to expose the support grid.

With reference now to FIG. 1, it is seen that the erosion barrier apparatus 10 generally comprises a plural number of support posts 31, a longitudinally extending support grid 11 and a longitudinally extending mesh material 20. The barrier 10 is designed to be positioned generally parallel to the shoreline of a body of water, preferably above the normal high water mark,such that the barrier 10 has an on-shore side 32 facing the land and an off-shore side 33 facing the water. The support posts 31 are generally vertical members buried into the ground a suitable distance to secure the grid 11 and mesh material 20 against the force of both incoming waves and the return water flow. The support posts 31 may be formed of any suitable material having sufficient strength and resistance-to-deterioration properties, such as wood, metal or preferably plastic such as PVC. The posts 31 are sized to extend several feet above ground level and the support grid 11 and mesh material 20 are attached to the posts 31 by any suitable known means. The support grid 11 and mesh material 20 may be attached permanently or temporarily, whereby the support grid 11 and mesh material 20 may be removed and stored when not required. Likewise, the support posts 31 may be only temporarily erected, or if required, the posts 31 may be mounted in concrete footings or the like to more permanently secure their position.

The support grid 11 comprises a number of gate apertures 12 defined by and contained within frame material 13. Frame material 13 is composed of any suitable material having suitable strength and non-deterioration properties in an outdoor marine environment, and is preferably composed of a polymer material having generally perpendicular horizontal members 14 and vertical members 15 intersecting to create generally rectangular or square gate apertures 12, although it is possible for the frame material to be designed in various patterns to create different configurations for the gate apertures 12, such as triangular, circular, etc. Preferably the frame material 13 is formed of a unitary member with the gate apertures 12 created by the production process, but alternatively the frame material 13 may be created by joining together, by adhesives, mechanical fasteners, stitching, welding or the like, horizontal and vertical members 14 and 15 to create the gate apertures 12, or the gate apertures 12 could be cut or stamped from an originally solid frame material 13. The frame material 13 should be strong with some flexibility, such that pressure from the water flow in either direction will not dramatically alter the shape of the gate apertures 12. Frame material 13 may be composed of a solid material or a material similar to mesh material 20.

The support grid 11 is composed of a large number of gate apertures 12 within frame material 13, such that the support grid 11 presents a generally open configuration to the water flow which does not overly impede the on-shore flow of water. The gate apertures 12 should occupy over 50 percent of the area of the support grid 11, and preferably should occupy a much higher percentage. The frame material 13 must be of sufficient area to retain the flaps 22 of the mesh material 20 such that the pressure from the return water flow will not force the flaps 22 through the gate apertures 12 to allow unimpeded flow of the sand-laden water back into the body of water. Gate apertures 12 are open areas which allow complete passage of water in either direction.

The second main component of the barrier 10 is the mesh material 20, which extends longitudinally and coextensively with support grid 11. The mesh material 20 is selectively affixed to the support grid 11 and support posts 31 such that the mesh material 20 forms the on shore side and the support grid 11 forms the off-shore side. The mesh material 20 is composed of any suitable material suitable for the outdoor marine environment with sufficient strength properties, comprising a very large number of small apertures created for example by woven or interconnecting strands or bands of material or by stamping or punching, and is preferably a woven polymer mesh fabric which is slightly flexible and relatively rigid. The mesh material 20 contains a large number of relatively small mesh apertures 21, which allow passage of water but not sand particles. Preferably, the mesh apertures 21 are sized to be smaller than the average particle size expected to be encountered, such that sand particles are completely prevented from passing through the mesh material 20. Preferably, the mesh apertures 21 are sized from approximately 0.2 mm to 1.0 mm. The mesh material 20 may for example be composed of material sold by Synthetics Industries under the brand names or designations woven monofilament geotextiles, which have water flow rates ranging from 18 to 200 gpm/ft$^2$, percent open areas ranging from 4 to 20%, permittivity ranging from 0.28 to 4.20 sec$^{31\ 1}$, and permeability ranging from 0.01 to 0.39 cm/sec.

Figure 4:
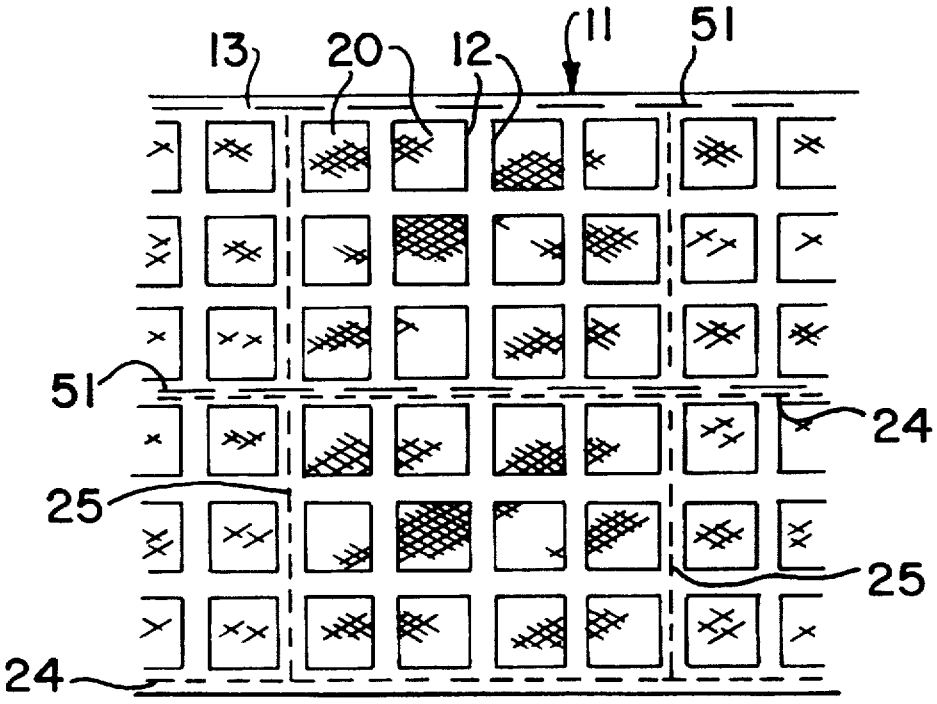
FIG. 4 is a view of the off-shore side of the apparatus, with the flaps of the mesh material shown in outline and where individual flaps overlap multiple gate apertures.
Figure 3:
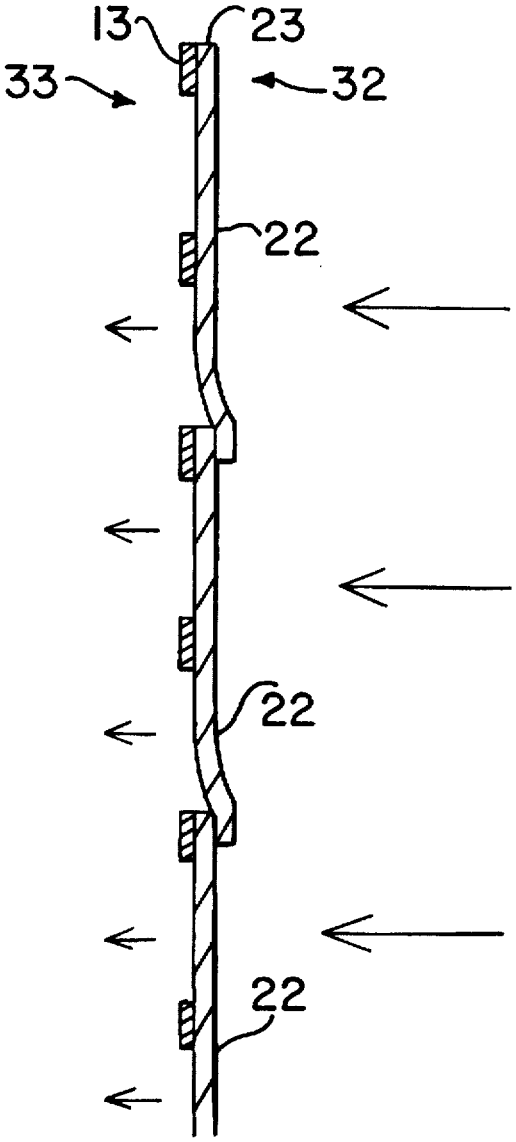
FIG. 3 is a cross-sectional view showing the response of the invention to return water flow in the off-shore direction.

The mesh material 20 is formed or adapted to contain a number of horizontal flaps 22, which are preferably formed by cutting separate strips of mesh material 20 and attaching the top edge 23 of each flap 22 to the frame material 13 by any suitable means, such as stitching, mechanical fastening, welding, adhesive application, etc. Preferably, the flaps 22 are sized such that the bottom edge 24 of each flap will overlap the top edge 23 of the flap 22 below, as shown in FIG. 3. Also preferably, the length of each flap 22 is sufficient to extend completely between or beyond adjacent posts 31. Alternatively, the flaps 22 may be formed by slitting the mesh material 20 to create individual flaps 22 having free side edges 25 and bottom edges 24, while the top edges 23 remained conjoined to the mesh material 20, as illustrated in FIG. 4.

The mesh material 20 is joined to the support grid 11 such that the flaps 22 are able to open in only one direction—the on-shore direction—with the frame material 13 of the support grid 11 preventing the unidirectional flaps 22 from opening in the off-shore direction. While it is possible to configure the barrier apparatus 10 such that a single flap 22 corresponds to a single gate aperture 12, it is much preferred that an individual flap 22 cover a number of gate apertures 12 in both the horizontal and vertical direction, as shown in FIG. 4. In the preferred embodiment wherein each flap 22 extends at least the complete distance between two posts 31, each horizontal flap 22 will be supported and restricted across its interior in the off-shore direction by all the vertical members 15 comprising frame material 13, making it virtually impossible for the flap 22 to be forced through the gate apertures 12 by the return water flow.

Figure 2:
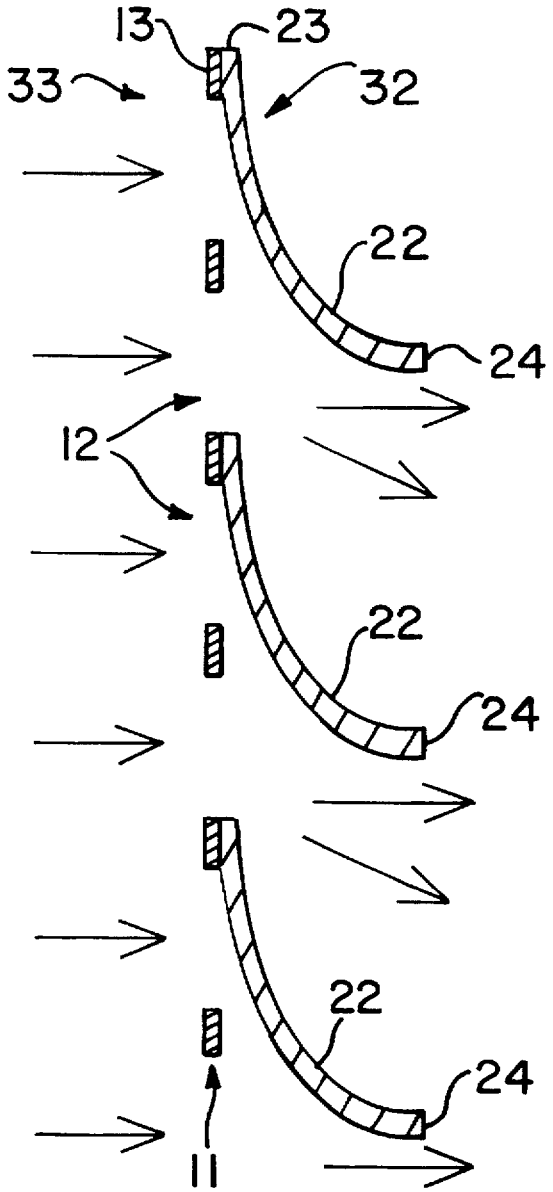
FIG. 2 is a cross-sectional view showing the response of the invention to large water flow in the on-shore direction.

The operation of the barrier apparatus 10 is illustrated in FIGS. 2 and 3. FIG. 2 shows the barrier 10 position in response to a large volume flow of water in the on-shore direction, such as would occur with storm surges or large waves. The high volume of water passes through the gate apertures 12 of the support grid 11 and strikes the off-shore sides of the flaps 22, forcing them to open in the on-shore direction. This allows the large volume of water to pass relatively unimpeded through the entire barrier apparatus 10, since only a relatively small amount of surface area is presented in the water flow path. Because the flaps 22 are able to open in the on-shore direction, the support posts 31 are able to maintain the support gird 11 and mesh material 20 in place even under extreme conditions. The flaps 22 would also open for water flow under slower conditions such as would be encountered in flood or high tide circumstances. Since the barrier 10 is positioned above the normal high tide mark, the surging water which passes through will strike relatively loose sand on the beach and entrap massive amounts of sand particles. The sand-laden water then returns in the off-shore direction to the body of water. This returning water strikes the on-shore side 32 of the flaps 22 and causes the flaps 22 in the mesh material 20 to be pushed against the support grid 11, as shown in FIG. 3. Since the frame material 13 of the support grid 11 prevents the flaps 22 from passing into the gate apertures 12, the uni-directional flaps 22 will act as a dam to the water returning in the off-shore direction. Because the force of the return flow of water in the off-shore direction is spread out over a longer time period and because the mesh material 11 allows passage of water through the small mesh apertures 21, the force and pressure of this returning water is dissipated and relieved such that the barrier 10 will not be breached or destroyed. Because the mesh apertures are sized to be relatively small, the sand borne by the returning water is caused to deposit on the on-shore side 32 of the barrier 10, either because the restricted flow of the water through the mesh apertures 21 sufficiently slows the water to allow the majority of the sand particles to settle to the bottom, or because the mesh apertures 21 are sized so as to preclude sand particles from passing through the mesh material 20 at all.

It is understood that equivalents and substitutions may be obvious to those skilled in the art for certain components set forth above. The true scope and definition of the invention therefore is to be as set forth in the following claims.

I claim:

1. An apparatus to control beach erosion comprising an elongated barrier adapted to be positioned along the shore line generally parallel to a body of water, the apparatus comprising a mesh material having a number of mesh apertures permeable to water and impermeable to sand particles of average size or smaller and a support grid coextensive with said mesh material in all directions and having gate apertures larger than said mesh apertures, said gate apertures of sufficient size to allow relatively unimpeded flow of water therethrough, said mesh material and said support grid mounted between support posts, said mesh material comprising flaps which are larger than said gate apertures, where said flaps abut against said support grid such that said flaps open in only one direction.

2. The apparatus of claim 1, where said mesh material is attached to said support grid.

3. The apparatus of claim 2, where each said mesh material flap has a top edge, and said top edge is attached to said support grid.

4. The apparatus of claim 3, where each said mesh material flap has a free bottom edge positioned to overlap a top edge of an adjacent mesh material flap.

5. The apparatus of claim 1, where each said mesh material flap extends the full distance between said posts.

6. The apparatus of claim 1, where said mesh apertures are sized between approximately 0.2 to 1.0 mm.

7. The apparatus of claim 1, where the direction through said support grid and then through said mesh material defines an on-shore direction and where the direction through said mesh material and then through said support grid defines an off-shore direction, and where water flow in the on-shore direction causes said mesh material flaps to open and where water flow in the off-shore direction causes said mesh material flaps to close such that water flows through said mesh apertures but sand particles are blocked by said apparatus.

8. The apparatus of claim 1, where said gate apertures comprise more than 50 percent of the surface area of said support grid.

9. The apparatus of claim 1, where each said flap extends across multiple gate apertures.

10. An apparatus to control beach erosion comprising an elongated barrier adapted to be positioned along the shore line generally parallel to a body of water, the apparatus comprising a support grid comprising a frame material and gate apertures of sufficient size to allow relatively unimpeded flow of water therethrough, and a mesh material having a number of mesh apertures permeable to water and impermeable to sand particles of average size or smaller, said mesh material attached to said support grid and mounted between support posts, said mesh material further comprising flaps which are larger than said gate apertures, where said frame material prevents said flaps from passing into said gate apertures.

11. The apparatus of claim 10, where said gate apertures comprise more than 50 percent of the surface area of said support grid.

12. The apparatus of claim 10, where said mesh apertures are sized between approximately 0.2 to 1.0 mm.

13. The apparatus of claim 10, where each said flap extends across multiple gate apertures.

* * * * *